US007263925B1

(12) United States Patent
Hansen et al.

(10) Patent No.: US 7,263,925 B1
(45) Date of Patent: Sep. 4, 2007

(54) HYDRAULIC AXIAL PISTON MACHINE

(75) Inventors: Ove Thorboel Hansen, Nordborg (DK); Lars Martensen, Soenderborg (DK)

(73) Assignee: Danfoss A/S, Nordborg (DK)

( * ) Notice: Subject to any disclaimer, the term of this patent is extended or adjusted under 35 U.S.C. 154(b) by 26 days.

(21) Appl. No.: 11/222,143

(22) Filed: Sep. 8, 2005

(30) Foreign Application Priority Data

Sep. 10, 2004 (DE) ..... 10 2004 043 745

(51) Int. Cl.
*F01B 3/00* (2006.01)
*F01B 31/10* (2006.01)

(52) U.S. Cl. ..... 92/71; 92/155; 91/499

(58) Field of Classification Search ..... 92/12.2, 92/71, 155; 91/499, 505; 417/222.1, 269
See application file for complete search history.

(56) References Cited

U.S. PATENT DOCUMENTS 6,582,200 B2 * 6/2003 Kato et al. ..... 92/71
2003/0094096 A1 * 5/2003 Stolzer ..... 92/71

* cited by examiner

*Primary Examiner*—Michael Leslie
(74) *Attorney, Agent, or Firm*—McCormick, Paulding & Huber LLP

(57) ABSTRACT

The invention concerns a hydraulic axial piston machine (1) with a cylinder body (3), at least one piston (9) to be axially displaceable in the cylinder body (3), said piston (9) resting on a swash plate (13) by way of a slide shoe (11), with a pressure plate (14) loading the slide shoe (11) in the direction of the swash plate (13), and a hold-down part (16), which bears with a contact surface (18) on a counter surface (20) of the pressure plate(14) facing away from the swash plate (13). It is endeavored to operate the machine with as little wear as possible. For this purpose, it is ensured that the contact surface (18) is formed by a circumferential surface section of a cone, whose peak (19) is directed towards the swash plate (13).

13 Claims, 1 Drawing Sheet

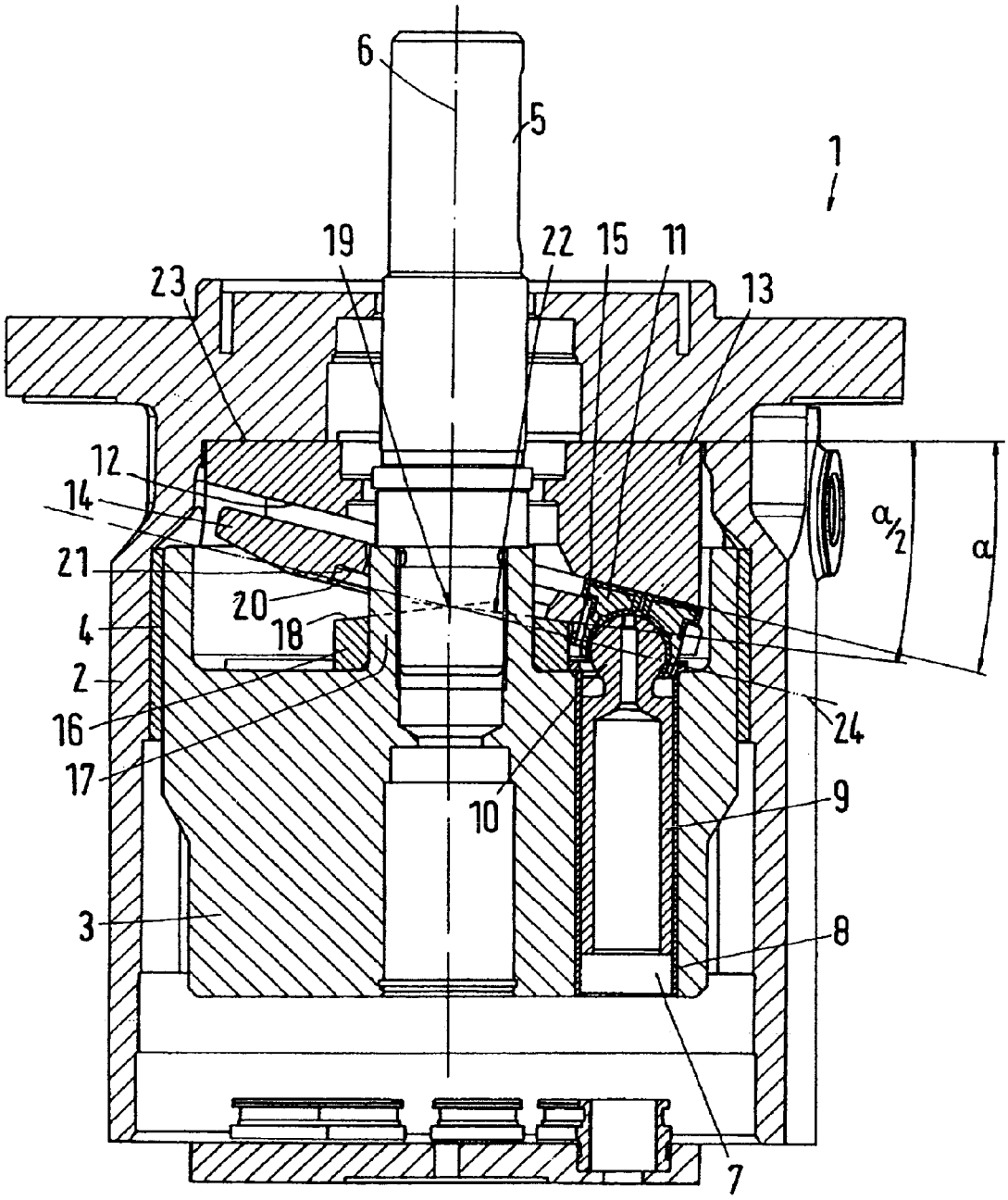
6
5
1
19
22
15
11
23
13
12
14
21
20
18
4
2
16
17
10
9
3
8
7
24
α/2
α

HYDRAULIC AXIAL PISTON MACHINE

CROSS-REFERENCE TO RELATED APPLICATIONS

Applicant hereby claims foreign priority benefits under U.S.C. § 119 from German Patent Application No. 10 2004 043 745.9 filed on Sep. 10, 2004, the contents of which are incorporated by reference herein.

FIELD OF THE INVENTION

The invention concerns a hydraulic axial piston machine with a cylinder body, at least one piston to be axially displaceable in the cylinder body, said piston resting on a swash plate by way of a slide shoe, with a pressure plate loading the slide shoe in the direction of the swash plate, and a hold-down part, which bears with a contact surface on a counter surface of the pressure plate facing away from the swash plate.

BACKGROUND OF THE INVENTION

Such an axial piston machine is known from DE 43 01 120 C2. Here, the hold-down part has the form of a piston, which is supported in the cylinder body by way of a spring. The piston has a front side, which is perpendicular to the axis of the cylinder body. On this plane front side, the pressure plate bears, said pressure plate having in this area a cone shape.

Such axial piston machines usually work satisfactorily. However, with a number of operating conditions wear problems occur, particularly when such a machine is used in connection with demineralised water.

In principle, wear occurs everywhere, where parts are moving in relation to and rubbing on each other. When water is used as hydraulic fluid, the lubricating effect of the hydraulic fluid is missing. In many areas, a suitable material pairing will ensure that a relatively thin layer of fluid is sufficient, also when the fluid has no lubricating effect. However, it is relatively difficult to provide such a fluid layer in the contact zone between the contact surface and the counter surface.

Accordingly, a wear particularly occurs in the contact area between the hold-down part and the pressure plate.

BRIEF SUMMARY OF THE INVENTION

The invention is based on the task of operating a machine with as little wear as possible.

With a hydraulic axial piston machine as mentioned in the introduction, this task is solved in that the contact surface is formed by a circumferential surface section of a cone, whose peak is directed towards the swash plate.

This embodiment provides a reduction of the friction between the hold-down part and the pressure plate. The pressure plate rolls off from the contact surface of the hold-down part, so that the share of rolling friction increases and the share of sliding friction decreases. The smaller the share of sliding friction, the smaller the wear.

Preferably, the counter surface is formed by a circumferential surface section of a counter cone, whose peak is directed towards the cylinder body. With this embodiment, two cone circumferential surfaces roll off from each other. With such an embodiment, the share of sliding friction can be kept very small. The wear is correspondingly small.

Preferably, the cone has a cone angle, which is ⅓ to ⅔ of the cone angle of the counter cone. The more alike the cone angles, the smaller the share of sliding friction.

It is particularly preferred that both cone angles are equally large. This does not mean that they are equal in the mathematical sense of the word. Certain tolerances are permissible. The equality of the cone angles makes it possible that the contact occurs over a relatively large area (seen in the radial direction). In the circumferential direction, however, the contact remains an approximate line contact. With this embodiment, a contact between the hold-down part and the pressure plate is achieved, which is practically exclusively based on rolling friction.

Preferably, the cone angle amounts to 25 to 75 percent of the angle, under which the swash plate is inclined in relation to a plane, to which the axis of the cylinder body is perpendicular. With this embodiment it is achieved that the slide shoe can be held on the swash plate in a substantially tilt-free manner.

In a particularly preferred embodiment, it is ensured that the cone angle is half as large as the angle. Thus, the angle of the swash plate (swash plate angle) is divided between the contact surface and the counter surface. In this case the smallest wear occurs with a reliable bearing of the slide shoe on the swash plate.

Preferably, the counter surface is located in a central recess of the pressure plate. This involves several advantages. Firstly, this permits some kind of self-centering of the pressure plate in relation to the hold-down part. Secondly, a sufficiently thick pressure plate is available in the area of the slide shoe, so that the slide shoe can be held on the swash plate with sufficient force. Finally, the weight of the pressure plate is kept small, so that the dynamic properties of the machine are improved.

Preferably, the hold-down part has the form of a ring, which surrounds the bearing shaft of the cylinder body. Thus, the hold-down part is fixed and cantered at the cylinder body.

Preferably, the contact surface of the hold-down part is made of plastic or ceramic. Particularly, when the machine is to be driven with water or even demineralised water as hydraulic medium, the use of a contact surface of plastic or ceramic permits low-friction interaction of the hold-down part and the pressure plate.

It is preferred that the hold-down part is made of plastic or ceramic. This reduces the risk that the friction-reducing layer peels off from the hold-down part.

It is also advantageous when the contact surface and/or the counter surface have a coating. This coating can also be chosen so that it contributes to the friction reduction of the relative movement between the hold-down part and the pressure plate. Such a coating can, for example, contain carbon, DLC (Diamond Like Coating).

Preferably, the slide shoe is connected with the piston via a ball, a line through the centre of the ball in parallel with the swash plate and the peaks of cone and counter-cone intersect each other in a point. This ensures that no tilting movements occur during operation.

In the following, the invention is described on the basis of a preferred embodiment in connection with the drawing, showing:

BRIEF DESCRIPTION OF THE DRAWINGS

Only FIGURE is a schematic longitudinal section through an axial piston machine.

DETAILED DESCRIPTION OF THE INVENTION

A hydraulic axial piston machine 1 has a housing 2, in which a cylinder body is supported to be rotatable. The cylinder body 3 is also called "cylinder drum". It is, for example, supported in the circumferential direction on the housing 2 via a bearing 4.

The cylinder body 3 is unrotatably connected with a shaft 5, which extends from the housing 2. Also the shaft 5 can be supported in the housing 2 by means of bearings, which are not shown in detail. Together with the shaft 5, the cylinder body 3 is rotatable around a rotation axis 6.

Several cylinders 7, of which only one is visible, are located in the cylinder body 3. The cylinder 7 has a lining of a plastic material, for example polyether etherketone (PEEK).

A piston 9 is arranged to be movable in the cylinder 7 in parallel to the rotation axis 6, that is, axially. At an end extending from the cylinder body 3, the piston 9 has a head in the shape of a ball 10. On the ball is fixed a slide shoe 11, which can accordingly be tilted in certain areas in relation to the piston 9.

The slide shoe 11 bears on a guiding surface 12 of a swash plate 13. A pressure plate 14 is provided to ensure the bearing of the slide shoe 11 on the guiding surface 12 of the swash plate 13. For each slide shoe 11, the pressure plate 14 has an opening 15. At the contact areas for the ball 10 and the swash plate 13, the slide shoe is provided with a layer of a friction-reducing plastic, for example PEEK. Additionally, fluid paths are provided, through which the hydraulic fluid can reach the contact areas.

A hold-down part 16 in the form of a ring is located at the cylinder body 3 and surrounds an annular flange 17, through which the shaft 5 is guided. The hold-down part 16 is made of a plastic material, for example polyether etherketone (PEEK), or a ceramic material. On the side facing the pressure plate 14, the hold-down part has a contact surface 18, which is made to be conical. Or rather, the contact surface is part of a circumferential surface of a cone, whose peak 19 points in the direction of the pressure plate 14.

The contact surface 18 interacts with a counter surface 20, which is formed in the pressure plate 14. The counter surface 20 forms the bottom of a recess 21, which is located approximately in the centre of the pressure plate 14. The shaft 5 is guided through the counter surface 20.

Also the counter surface 20 is made as a circumferential surface of a cone 22, whose peak points in the direction of the cylinder body 3.

The angles of the two circumferential cone surfaces, that is, the contact surface 18 and the counter surface 20, have equal sizes. However, this equality is not meant in the strict mathematical sense of the word. Tolerances, which could occur during manufacturing and which are usually smaller than 10, can be accepted right away.

Together with a plane 23, which is perpendicular to the rotation axis 6, the guiding surface 12 and the swash plate 13 encloses an angle $\alpha$. This angle amounts to, for example, 14°. The angles of the two circumferential cone surfaces of the contact surface 18 and the counter surface 20 amount to $\alpha/2$, that is, this angles is half the size of the angle of the swash plate 13, for example 7°.

With this design, the peak of the cone 22 (theoretically) corresponds to the peak 19 of the cone of the hold-down part 16. A line 24 still extends through this point on through the centre of the ball 10 in parallel with the guiding surface 12.

Through this design of the contact surface and the circumferential cone surface with practically the same angles it is achieved that a pure rolling friction is practically achieved between the hold-down part 16 and the pressure plate 14. With such a rolling friction the wear is extremely small. The fact that the line 24 extends through the peak 19 of the cone prevents the slide shoe 11 from tilting in relation to the guiding surface 12.

The hold-down part 16 can, however, does not have to, be made completely of a plastic material. In many cases, it will be sufficient to provide its surface with plastic or ceramic. Particularly here, the friction-reducing properties are essential. Additionally, the contact surface 18 and/or the counter surface 20 can be coated, for example with DLC (Diamond Like Coating).

When the shaft 5 extends through the other side of the cylinder body 3, the ring can be replaced by another body, for example a piston or a top part. In each case, however, it should be ensured that the contact surface 18 has a cone shape.

For reasons of clarity, the means provided for generating a force on the pressure plate 14, for example one or more springs or hydraulic power generators, are not shown.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A hydraulic axial piston machine with a cylinder body, at least one piston to be axially displaceable in the cylinder body, said piston resting on a swash plate by way of a slide shoe, with a pressure plate loading the slide shoe in the direction of the swash plate, and a hold-down part, which bears with a contact surface on a counter surface of the pressure plate facing away from the swash plate, wherein the contact surface is formed by a circumferential surface section of a cone, whose peak is directed towards the swash plate.

2. The hydraulic axial piston machine according to claim 1, wherein the counter surface is formed by a circumferential surface section of a counter cone, whose peak is directed towards the cylinder body.

3. The hydraulic axial piston machine according to claim 2, wherein the cone has a cone angle, which is ⅓ to ⅔ of a cone angle of the counter cone.

4. The hydraulic axial piston machine according to claim 3, wherein the cone angle amounts to 25 to 75 percent of an angle $\alpha$, under which angle $\alpha$ the swash plate is inclined in relation to a plane, to which plane the axis of the cylinder body is perpendicular.

5. The hydraulic axial piston machine according to claim 4, wherein the cone angle is half as large as the angle $\alpha$.

6. The hydraulic axial piston machine according to claim 2, wherein cone angles of the cone and the counter cone are equally large.

7. The hydraulic axial piston machine according to claim 2, wherein the slide shoe is connected with the piston via a ball, a line through the centre of the ball in parallel with the swash plate and the peaks of cone and counter-cone intersect each other in a point.

8. The hydraulic axial piston machine according to claim 1, wherein the counter surface is located in a central recess of the pressure plate.

9. The hydraulic axial piston machine according to claim 1, wherein the hold-down part has the form of a ring, which surrounds a shaft extending through the cylinder body.

10. The hydraulic axial piston machine according to claim 9, wherein the cylinder body is supported on the shaft by an annular flange, the annular flange being arranged between the hold-down part and the shaft.

11. The hydraulic axial piston machine according to claim 1, wherein the contact surface of the hold-down part is made of plastic or ceramic.

12. The hydraulic axial piston machine according to claim 11, wherein the hold-down part is made of plastic or ceramic.

13. The hydraulic axial piston machine according to 1, wherein the contact surface and/or the counter surface has a coating.

* * * * *